US011777251B2

(12) United States Patent
Sasaki et al.

(10) Patent No.: US 11,777,251 B2
(45) Date of Patent: Oct. 3, 2023

(54) CONNECTOR INCLUDING PACKING HAVING ANNULAR SEAL PORTION AND ANNULAR DEPRESSED PORTION

(71) Applicant: YAZAKI CORPORATION, Tokyo (JP)

(72) Inventors: Yasuhiro Sasaki, Makinohara (JP); Akihiro Tsuruta, Fujieda (JP); Masayuki Yamamoto, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 72 days.

(21) Appl. No.: 17/489,692

(22) Filed: Sep. 29, 2021

(65) Prior Publication Data

US 2022/0102907 A1 Mar. 31, 2022

(30) Foreign Application Priority Data

Sep. 30, 2020 (JP) ..... 2020-165929

(51) Int. Cl.

| | |
|---|---|
| ***H01R 13/40*** | (2006.01) |
| ***H01R 13/52*** | (2006.01) |
| ***H01R 13/504*** | (2006.01) |
| ***H01R 13/629*** | (2006.01) |

(52) U.S. Cl.

CPC ..... *H01R 13/5219* (2013.01); *H01R 13/504* (2013.01); *H01R 13/5202* (2013.01); *H01R 13/629* (2013.01); *H01R 13/5216* (2013.01)

(58) Field of Classification Search

CPC ..... H01R 13/5219; H01R 13/504; H01R 13/5202; H01R 13/629; H01R 13/5216

USPC ..... 439/587

See application file for complete search history.

(56) References Cited

U.S. PATENT DOCUMENTS

| | | | | |
|---|---|---|---|---|
| 4,611,872 | A * | 9/1986 | Ito | H01R 13/5219 439/587 |
| 4,944,688 | A * | 7/1990 | Lundergan | H01R 13/5221 439/752 |
| 5,336,101 | A * | 8/1994 | Kasugai | H01R 13/639 439/272 |
| 5,389,005 | A * | 2/1995 | Kodama | H01R 13/5219 439/282 |

(Continued)

FOREIGN PATENT DOCUMENTS

| | | |
|---|---|---|
| JP | 2011-150835 A | 8/2011 |
| JP | 2012-14981 A | 1/2012 |

*Primary Examiner* — Abdullah A Riyami
*Assistant Examiner* — Vladimir Imas
(74) *Attorney, Agent, or Firm* — KENEALY VAIDYA LLP

(57) ABSTRACT

A connector includes a housing; and an annular packing to be sandwiched between the housing and a mating component. The packing has: an annular seal portion protruding toward a radially outer side, and an annular depressed portion located on a surface of the seal portion on the radially inner side and depressed toward the radially outer side. An edge of the depressed portion is positioned on one side with respect to a protruding end of the seal portion. When the housing and the mating component are fitted to each other, the protruding end of the seal portion is in contact with the mating component, the edges of the depressed portion are in contact with the housing, and the end portion is displaced in a direction away from the housing to warp with a vicinity of the edge on the one side as a center.

3 Claims, 10 Drawing Sheets

(56) References Cited

U.S. PATENT DOCUMENTS 5,492,487 A * 2/1996 Cairns ..... H01R 13/5219 439/271
5,618,204 A * 4/1997 Nix ..... H01R 13/6456 439/271
5,713,761 A * 2/1998 Okayasu ..... H01R 13/5219 439/732
5,782,658 A * 7/1998 Maegawa ..... H01R 13/5219 439/271
6,045,383 A * 4/2000 Fujiwara ..... H01R 13/5219 439/271
6,368,131 B1 * 4/2002 Takeuchi ..... H01R 13/5208 439/271
6,443,764 B2 * 9/2002 Makita ..... H01R 13/5219 439/271
6,913,494 B2 * 7/2005 Ward ..... H01R 13/64 439/352
6,994,590 B2 * 2/2006 Nishida ..... H01R 13/5219 439/271
7,033,201 B2 * 4/2006 Ichida ..... H01R 13/6272 439/352
7,044,762 B1 * 5/2006 Hong ..... H01R 13/5219 439/283
7,594,821 B1 * 9/2009 Hasija ..... H01R 13/5202 439/271
7,611,369 B2 * 11/2009 Matsunaga ..... H01R 13/631 439/271
7,785,145 B2 * 8/2010 Menez ..... H01R 13/6315 439/271
8,187,042 B2 * 5/2012 Kimura ..... H01R 13/4365 439/271
8,215,987 B2 * 7/2012 Yoshioka ..... H01R 13/4362 439/587
8,403,693 B2 * 3/2013 Uchida ..... H01R 13/5227 439/271
8,777,648 B2 * 7/2014 Kitajima ..... H01R 13/5202 439/271
8,979,580 B2 * 3/2015 Bitzer ..... H02K 5/10 439/271
8,992,249 B2 * 3/2015 Kobayashi ..... H01R 13/6581 439/564
9,379,477 B2 * 6/2016 Endo ..... H01R 13/60
9,570,839 B2 * 2/2017 Hashimoto ..... H01R 13/5202
9,825,398 B1 * 11/2017 Uchida ..... G04G 99/00
10,224,666 B2 * 3/2019 Aoshima ..... H01R 13/648
10,367,292 B2 * 7/2019 Furuya ..... H01R 13/5202
10,490,931 B2 * 11/2019 Furuya ..... H01R 13/5208
10,630,021 B2 * 4/2020 Shiraishi ..... H01R 13/502
2011/0111610 A1 * 5/2011 Kim ..... H01R 13/6599 439/157
2011/0300731 A1 * 12/2011 Nakamura ..... H01R 43/18 439/271
2014/0213088 A1 7/2014 Furuya et al.
2015/0180159 A1 * 6/2015 Endo ..... H01R 13/516 439/587
2016/0156124 A1 6/2016 Hashimoto

* cited by examiner

CONNECTOR INCLUDING PACKING HAVING ANNULAR SEAL PORTION AND ANNULAR DEPRESSED PORTION

CROSS-REFERENCE TO RELATED APPLICATIONS

This application is based on and claims priority under 35 USC 119 from Japanese Patent Application No. 2020-165929 filed on Sep. 30, 2020, the contents of which are incorporated herein by reference.

TECHNICAL FIELD

The present invention relates to a connector including a housing to be fitted to a mating component and an annular packing sandwiched between the housing and the mating component.

BACKGROUND ART

Conventionally, there has been proposed an annular packing which is used to be sandwiched between a pair of connectors to be fitted to each other and to achieve water stop or the like between the two connectors. For example, this type of packing includes a seal portion (for example, a so-called lip portion) that comes into contact with both the inner peripheral surface of the housing of one connector and the outer peripheral surface of the housing of the other connector, and seals the space between the inner peripheral surface and the outer peripheral surface described above by bringing the seal portion into contact with both the inner peripheral surface and the outer peripheral surface described above.

As for details of the above connector, refer to JP 2012-014981 A.

When the above-described packing is actually used, the seal portion of the packing is sandwiched between the pair of connectors and is crushed in a thickness direction (that is, a radial direction of the annular packing). At this time, in general, the rubber material or the like constituting the seal portion is elastically compressed in the thickness direction and is deformed toward the periphery of the seal portion (that is, in the fitting direction of the pair of connectors). Here, the latter deformation (that is, deformation in the fitting direction) proceeds while resisting the frictional force generated between the rubber material or the like of the seal portion and the housing surface. When the frictional force is excessively large, the latter deformation becomes difficult, and the former deformation (that is, deformation in the thickness direction) becomes difficult, which may result in a large external force being required for fitting the connector. On the other hand, when the rubber material or the like is inadvertently soft in order to facilitate the deformation of the packing, the original seal performance required for the packing may be impaired. In this way, it is generally difficult to achieve both the seal performance of the packing and the workability of the operation of fitting the connector using the packing.

SUMMARY OF INVENTION

Aspect of non-limiting embodiments of the present disclosure relates to provide a connector capable of achieving both the seal performance of the packing and the workability of the operation of fitting the connector using the packing.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a connector comprising:

a housing to be fitted to a mating component; and an annular packing to be sandwiched between the housing and the mating component and comes into contact with both the housing and the mating component, the packing having:

an annular seal portion protruding toward a radially outer side at a position away from an end portion on one side of the packing in a fitting direction of the housing and the mating component toward another one side in the fitting direction, and an annular depressed portion located on a surface of the seal portion on the radially inner side and depressed toward the radially outer side, an edge of the depressed portion on the one side being positioned on the one side with respect to a protruding end of the seal portion, the housing being disposed on a radially inner side of the packing, upon the housing and the mating component being fitted to each other, the protruding end of the seal portion being in contact with the mating component, the edge of the depressed portion on the one side and an edge of the recessed portion on the another one side being in contact with the housing, and the end portion being displaced in a direction away from the housing to warp with a vicinity of the edge on the one side as a center.

BRIEF DESCRIPTION OF DRAWINGS

Exemplary embodiment(s) of the present invention will be described in detail based on the following figures, wherein.

DESCRIPTION OF EMBODIMENTS

Figure 1:
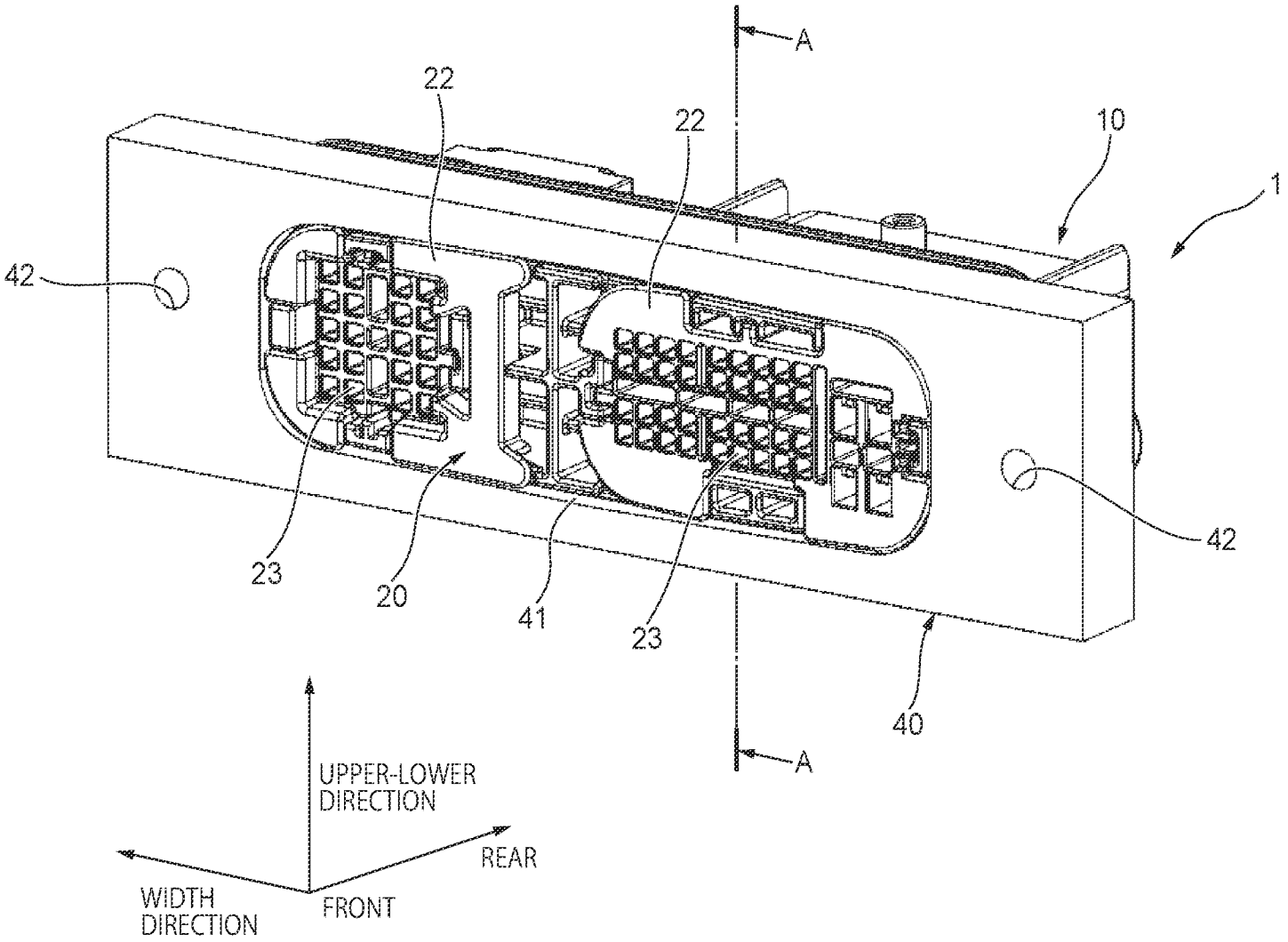
FIG. 1 is a perspective view showing a state in which a housing included in a connector according to an embodiment of the present invention and a mating component is completed.
Figure 2:
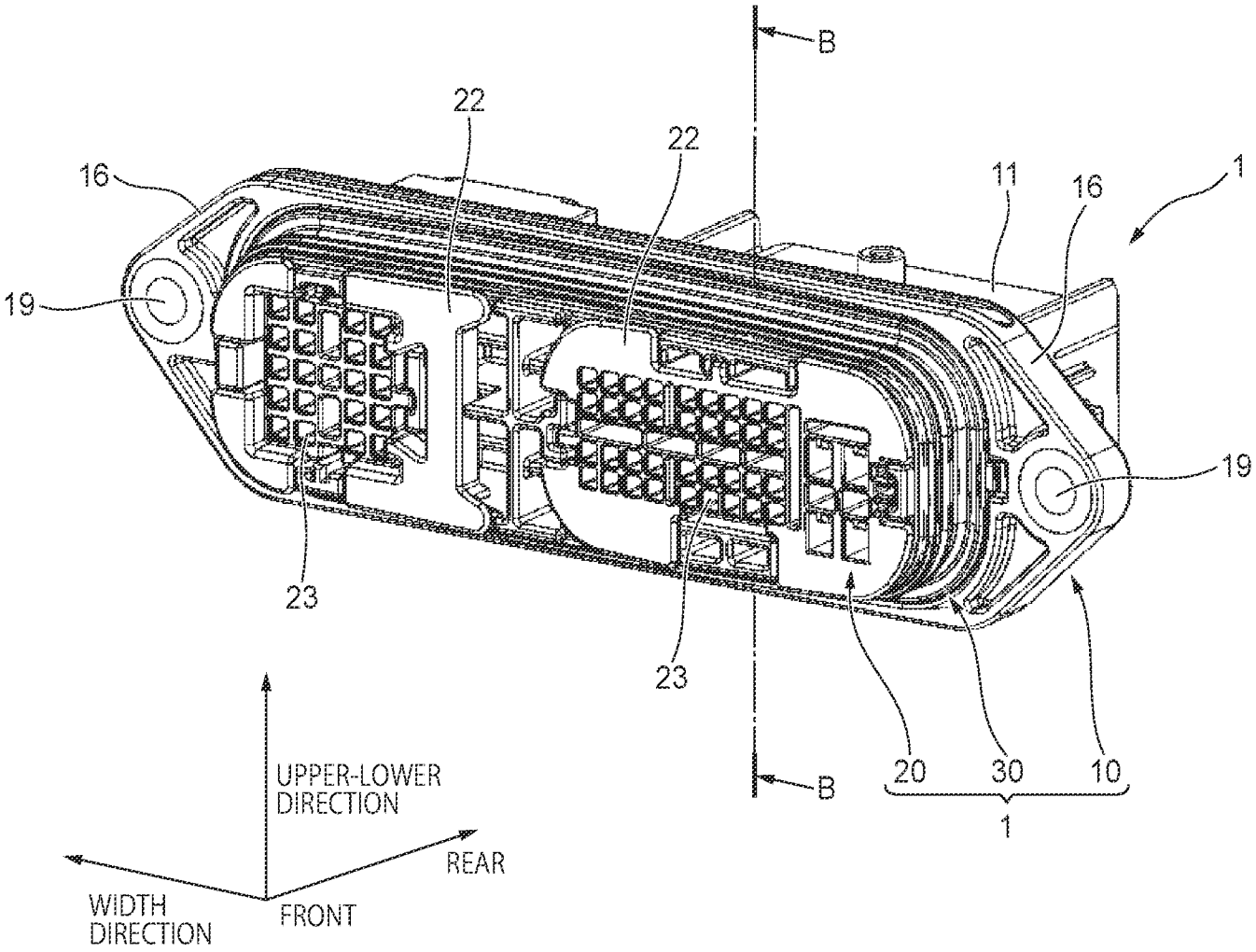
FIG. 2 is a perspective view of the connector according to the embodiment of the present invention.
Figure 3:
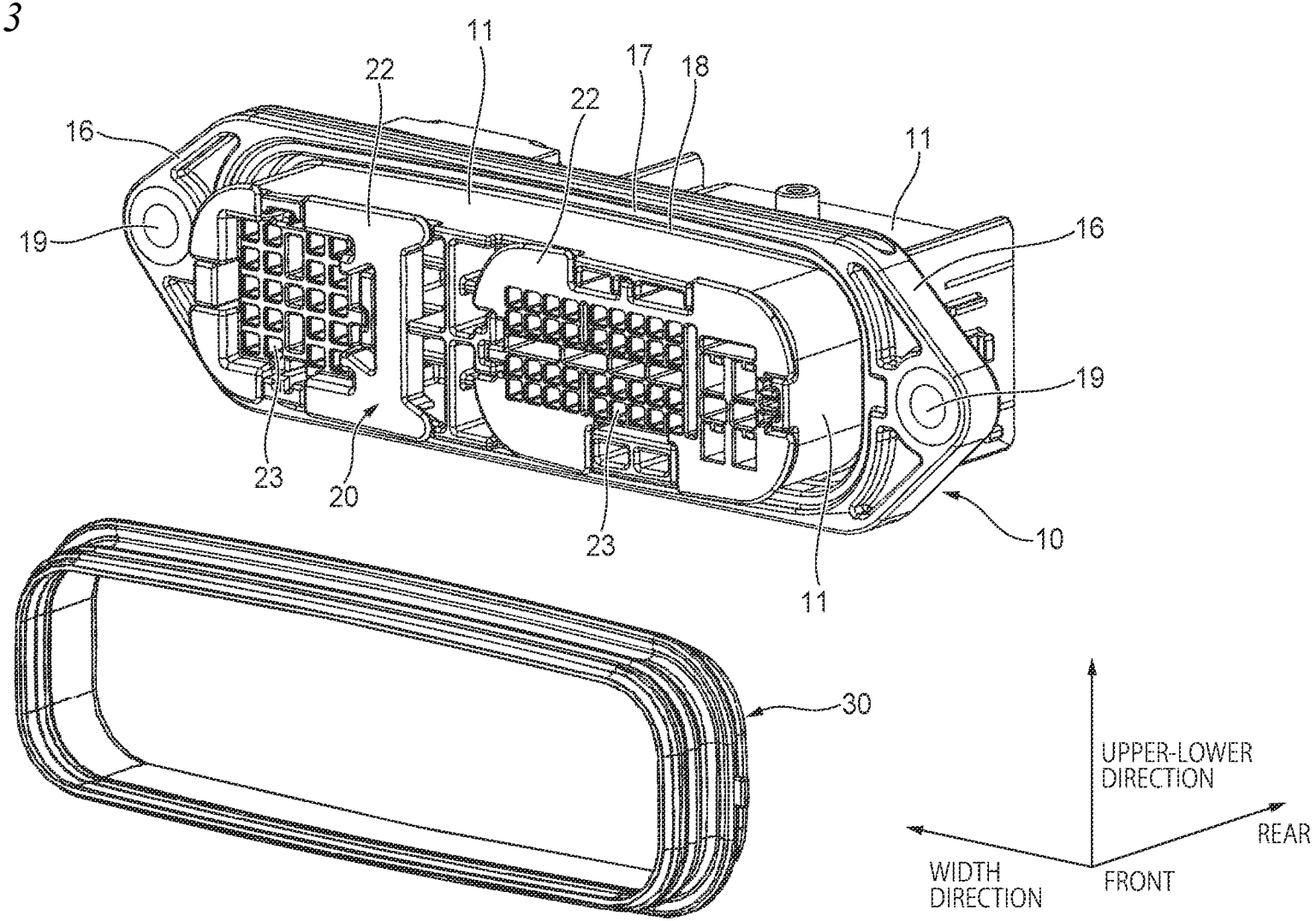
FIG. 3 is a perspective view showing the connector from which the packing is removed and a packing.
Figure 6:
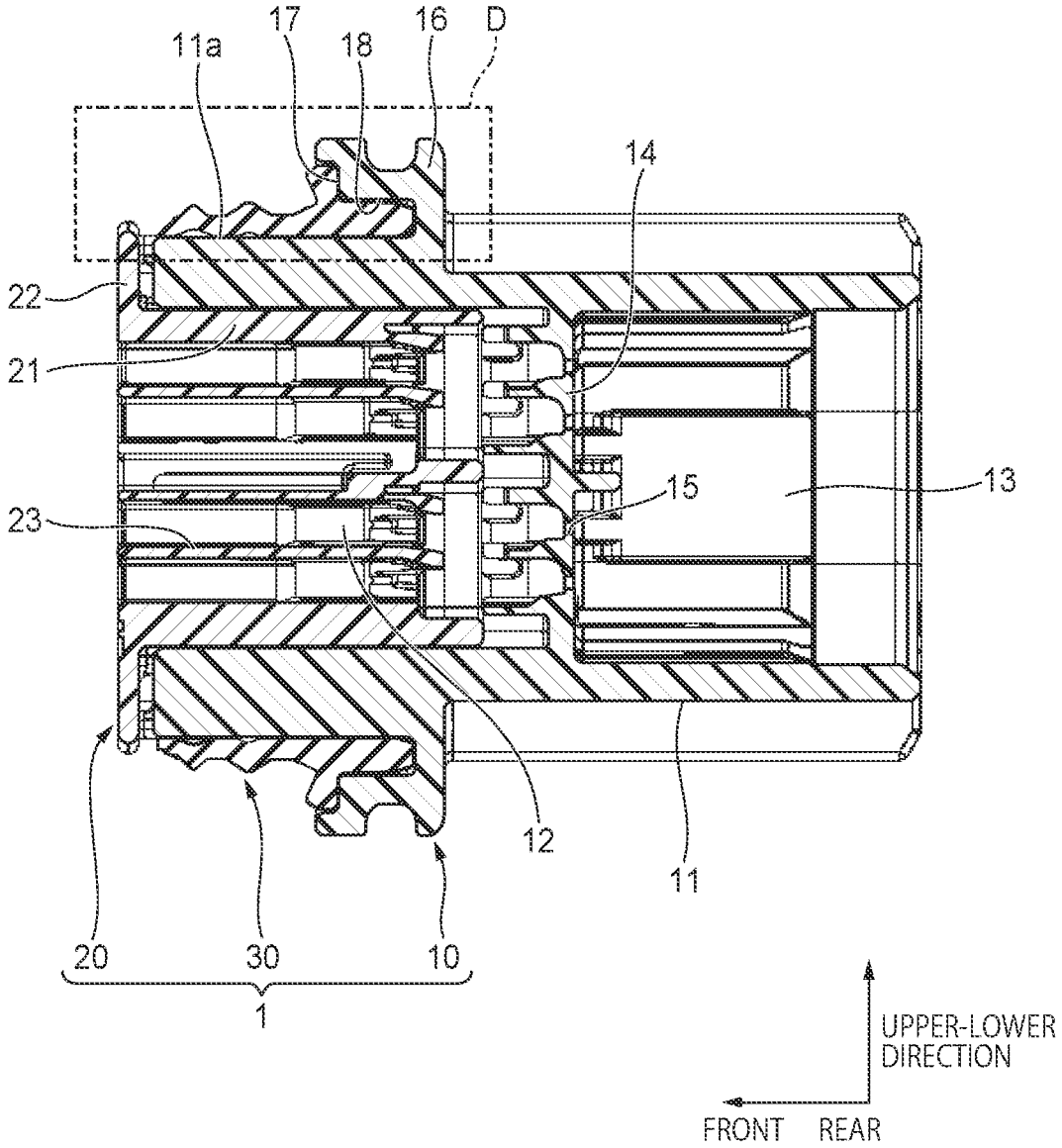
FIG. 6 is a cross-sectional view taken along a line B-B of FIG. 2.

Hereinafter, a connector 1 according to an embodiment of the present invention will be described with reference to the Figures. As shown in FIG. 1, the connector 1 is used by being fitted to a mating component 40. In this example, the mating component 40 is a part of the exterior walls of various device cases. As shown in FIGS. 2, 3, and 6, the connector 1 includes a housing 10, a mating housing 20 accommodated in the housing 10, and a packing 30 mounted on the housing 10. When the housing 10 on which the packing 30 is mounted is fitted to the mating component 40, the packing 30 exhibits the sealing function (see FIG. 10).

Hereinafter, for convenience of description, a "front-rear direction", a "width direction", an "upper-lower direction", a "front", and a "rear" are defined as illustrated in FIG. 1. The "front-rear direction", the "width direction", and the "upper-lower direction" are orthogonal to each other. The front-rear direction coincides with the fitting direction of the housing 10 and the mating component 40, the front side in the fitting direction (the side closer to the mating component 40) as viewed from the housing 10 is referred to as the "front side", and the fitting direction release side (the side away from the mating component 40) as viewed from the housing 10 is referred to as the "rear side". Specifically, in FIG. 1, with respect to both the housing 10 and the mating component 40, the left direction corresponds to the front side, and the right direction corresponds to the rear side. Hereinafter, each member of the connector 1 will be described in order.

Figure 4:
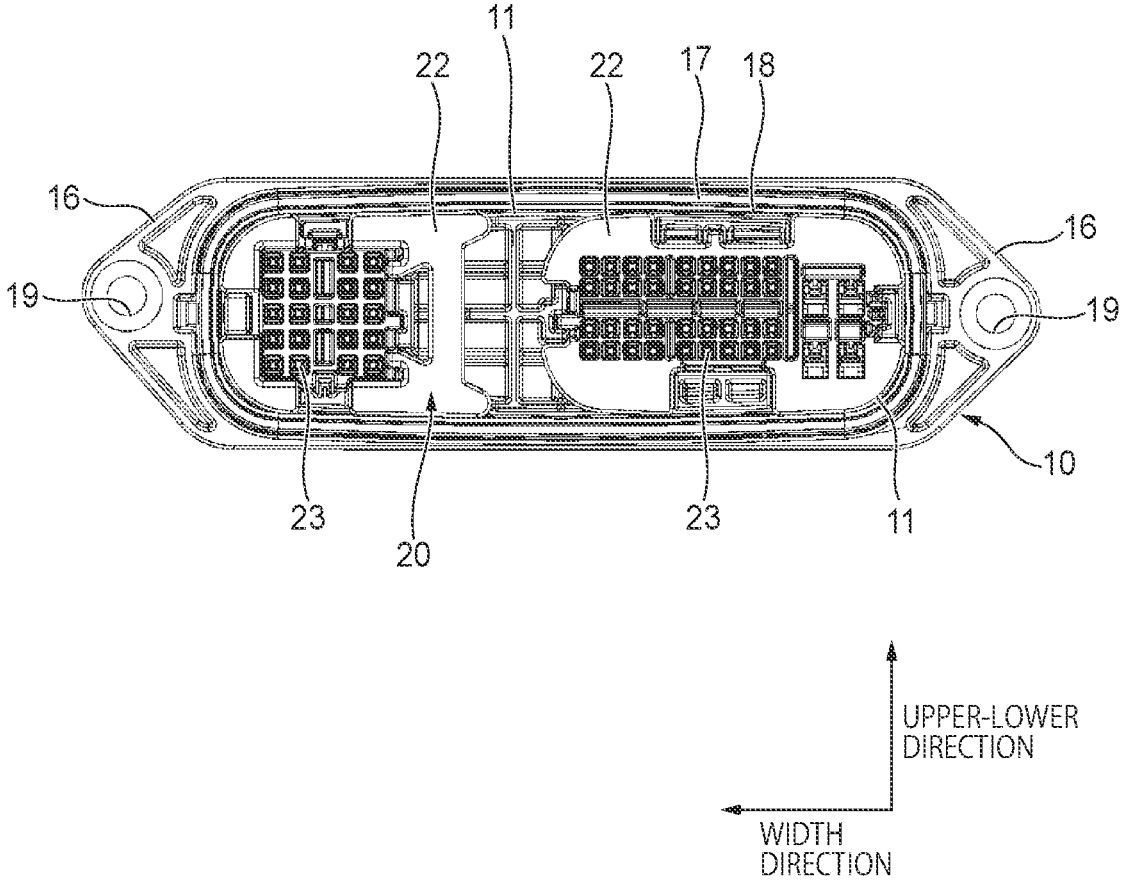
FIG. 4 is a front view of the connector from which the packing is removed.
Figure 5A:
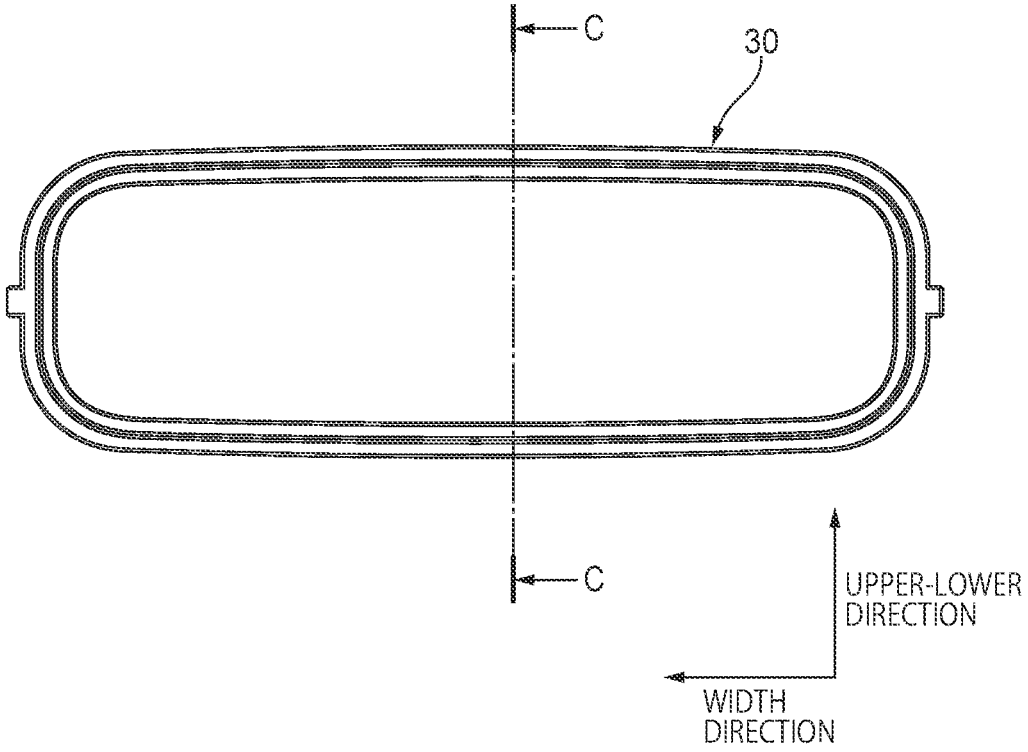
FIG. 5A is a front view of the packing shown in FIG. 3.
Figure 5B:
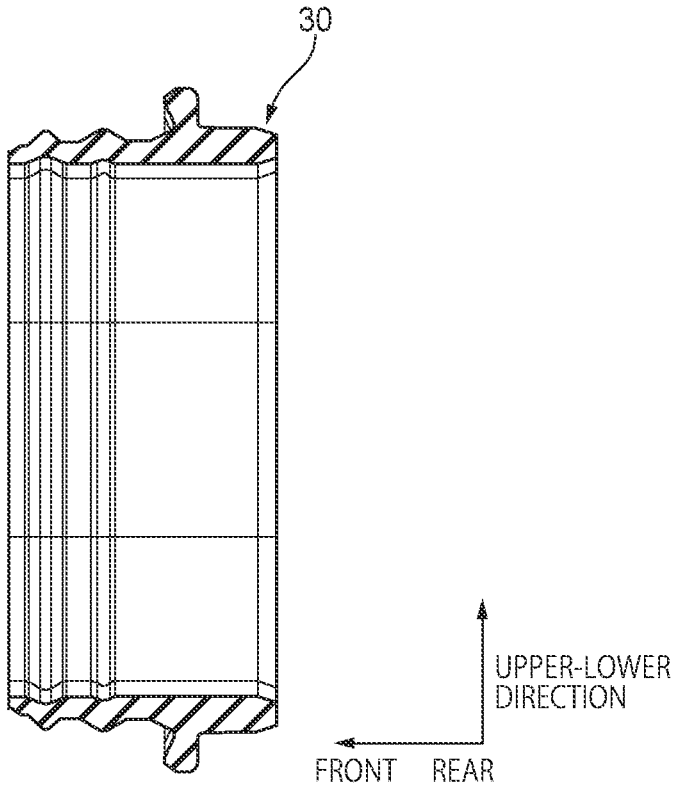
FIG. 5B is a cross-sectional view taken along a line C-C of FIG. 5A.

First, the housing 10 will be described. The housing 10 is a resin molded body, and as shown in FIGS. 3, 4, and 6, includes a substantially rectangular tubular portion 11 that expands in the width direction and extends in the front-rear direction. The tubular portion 11 includes a fitting recess 12 that is open at the front end of the tubular portion 11 and is depressed rearward, a fitting recess 13 that is open at the rear end of the tubular portion 11 and is depressed forward, and a partition wall 14 that partitions the fitting recess 12 and the fitting recess 13 in the front-rear direction. The partition wall 14 also serves as a bottom wall of each of the fitting recess 12 and the fitting recess 13. A main body 21 to be described later of the mating housing 20 is inserted into the fitting recess 12 from the front side, and another housing (not shown) is inserted into the fitting recess 13.

A through hole 15 penetrating in the front-rear direction is formed in the partition wall 14 corresponding to a plurality of terminal accommodating chambers 23 (see FIGS. 1 and 6, etc.) included in the mating housing 20 described later (see FIG. 6). A tab portion of a male terminal (not shown) accommodated in the terminal accommodating chamber 23 is inserted into the through hole 15.

An annular flange portion 16 that expands toward the radially outer side over the entire periphery of the tubular portion 11 is provided at a position on the outer peripheral surface of the tubular portion 11 on the front side of the partition wall 14 (see FIGS. 2 to 4 and 6). As shown in FIGS. 2 to 4, a pair of bolt holes 19 that penetrate the flange portion in the front-rear direction are provided at both end portions of the flange portion 16 in the width direction. Hereinafter, the outer peripheral surface of the tubular portion 11 positioned on the front side of the flange portion 16 will be referred to as an "outer peripheral surface 11*a*" in particular for convenience of description (refer to FIG. 6 and the like).

As shown in FIGS. 3, 4, 6, and 7, in the front end surface of the flange portion 16, a substantially rectangular annular recess 17 that opens forward and is depressed rearward (when viewed from the front) is formed. In a radially inner side region of a bottom surface (rear end surface) 17*a* (see FIG. 7) of the annular recess 17, a substantially rectangular annular groove portion 18 that opens to the bottom surface 17*a* and is depressed further rearward from the bottom surface 17*a* (when viewed from the front) is formed. A side surface of the annular groove portion 18 on the radially inner side is continuous with the outer peripheral surface 11*a* of the tubular portion 11 in the front-rear direction without a step over the entire periphery. A flange 37 and a rear end portion 36 described later of the packing 30 are respectively accommodated in the annular recess 17 and the annular groove portion 18 (see FIG. 7).

Next, the mating housing 20 will be described. As shown in FIGS. 2 to 4 and 6, the mating housing 20 is a resin molded body, and includes a main body portion 21 having an outer peripheral shape capable of being fitted into the fitting recess 12, and a flange portion 22 expanding toward the radially outer side from an outer peripheral surface of a front end portion of the main body portion 21 to an entire periphery of the main body portion 21. As shown in FIGS. 1 to 4, the main body 21 is provided with a plurality of terminal accommodating chambers 23 penetrating in the front-rear direction so as to be arranged in a matrix in the width direction and the upper-lower direction. A male terminal (not shown) is inserted into and accommodated in the terminal accommodating chamber 23 from the front side.

The mating housing 20 is accommodated in the housing 10 when the main body portion 21 is inserted into the fitting recess 12 of the housing 10 from the front side until the flange portion 22 comes into contact with the front end surface of the tubular portion 11 of the housing 10 (see FIG. 6).

Next, the packing 30 will be described. As shown in FIGS. 2, 3, 5A and 5B, the packing 30 is a resin (rubber) molded body and has a substantially rectangular tubular shape that expands in the width direction and extends in the front-rear direction corresponding to the outer peripheral surface 11*a* of the tubular portion 11 of the housing 10. As shown in FIG. 6, the packing 30 is externally inserted into the tubular portion 11 of the housing 10 from the front side, and is mounted on the outer peripheral surface 11*a* of the tubular portion 11 in a state where the flange 37 and the rear end portion 36 of the packing 30 are accommodated in the annular recess 17 and the annular groove portion 18, respectively (see FIG. 6).

Hereinafter, the detailed shape of the packing 30 will be described. Hereinafter, for convenience of description, the radially inner side and the radially outer side of the packing 30 are simply referred to as "radially inner side" and "radially outer side", respectively (see FIGS. 7 to 10).

Figure 7:
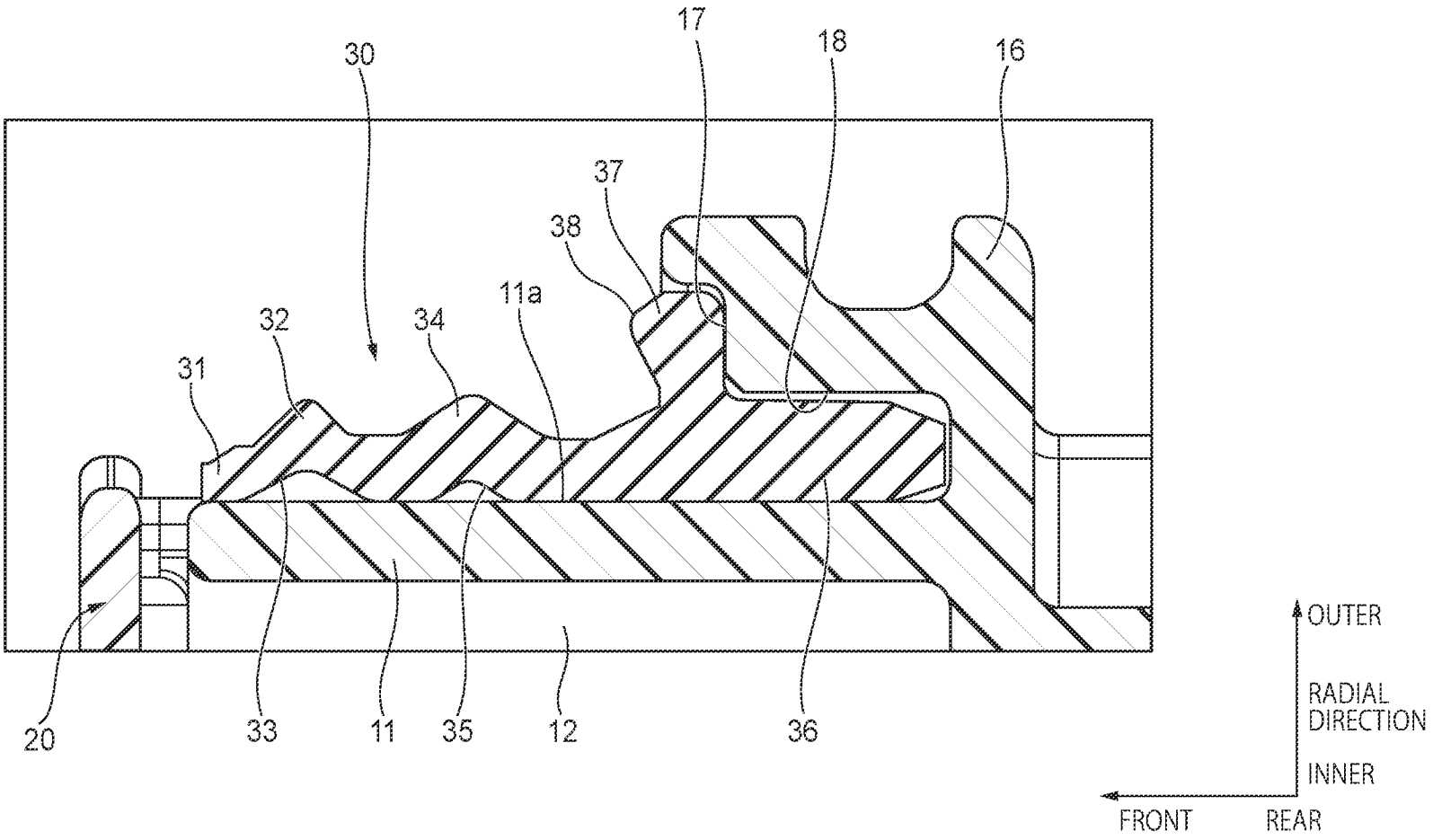
FIG. 7 is an enlarged view of a portion D in FIG. 6.
Figure 8A:
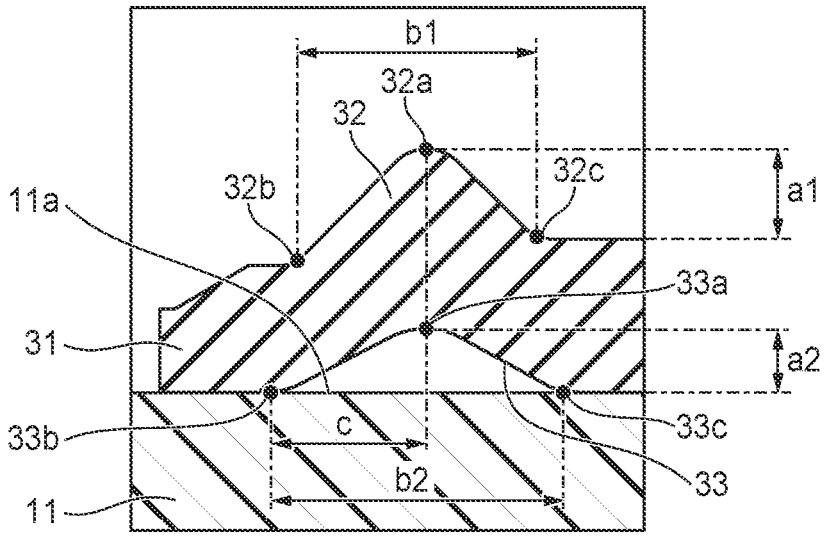
FIG. 8A is an enlarged view of the periphery of a first seal portion shown in FIG. 7.

As shown in FIG. 7, the packing 30 is provided with an annular first seal portion 32 protruding to a radially outer side at a position in the front-rear direction adjacent to the rear side of the front end portion 31 of the packing 30, and an annular first depressed portion 33 depressed to a radially outer side on a surface of the first seal portion 32 on the radially inner side. As shown in FIG. 8A, a leading edge 33*b* of the first depressed portion 33 is located forward of the protruding end 32*a* of the first seal portion 32 by a distance c in the front-rear direction. The action caused by this positional relationship will be described later. In this example, the position in the front-rear direction of the protruding end 32*a* of the first seal portion 32 and the position in the front-rear direction of the innermost end 33*a* of the groove inner surface of the first depressed portion 33 substantially coincide with each other.

The position of the leading edge 33*b* of the first depressed portion 33 may be referred to as a boundary portion between the groove inner surface of the first depressed portion 33 and the surface of the packing 30 on the radially inner side in contact with the surface of the tubular portion 11 of the connector 1 in a state where the connector 1 is not fitted. The same applies to a rear edge 33*c* to be described later.

As shown in FIG. 8A, the depression depth a2 of the first depressed portion 33 toward the radially outer side is smaller than the protruding height a1 of the first seal portion 32 toward the radially outer side, and the groove width (the front-rear direction distance between the leading edge 33*b* and the rear edge 33*c*) b2 of the first depressed portion 33 is larger than the protruding width (the front-rear direction distance between the leading edge 32*b* and the rear edge 32*c*) b1 of the first seal portion 32. In other words, the degree of depression of the first depressed portion 33 is gentler than the degree of protrusion of the first seal portion 32. Accordingly, when the packing 30 is molded by injection molding or the like, the first depressed portion 33 is likely to be separated from the mold (that is, the mold releasability is improved), and the productivity of the packing 30 can be improved.

The position of the leading edge 32*b* of the first seal portion 32 may be referred to as a boundary portion between the protrusion side surface of the first seal portion 32 and the surface of the packing 30 on the radially outer side extending substantially parallel to the surface of the tubular portion 11 of the connector 1 in a state where the connector 1 is not fitted. The same applies to a rear edge 32*c* to be described later.

As shown in FIG. 8A, the radial thickness of the first seal portion 32 at the protruding end 32*a* of the first seal portion 32 is larger than the radial thickness of the first seal portion 32 at the front-rear direction position different from the protruding end 32*a*. Furthermore, the portion of the first seal portion 32 where the thickness is the thinnest in the radial direction is located on the front side of the protruding end 32*a* of the first seal portion 32. Further, the volume of the annular groove space of the first depressed portion 33 is equal to or larger than the volume of the annular protruding shape of the first seal portion 32. The action caused by these dimensional relationships will be described later.

As shown in FIG. 7, the packing 30 is provided with an annular second seal portion 34 that protrudes to the radially outer side at a position in the front-rear direction that is away from the first seal portion 32 toward the rear side, and an annular second depressed portion 35 that is depressed toward the radially outer side on a radially inner side surface of the second seal portion 34.

Figure 8B:
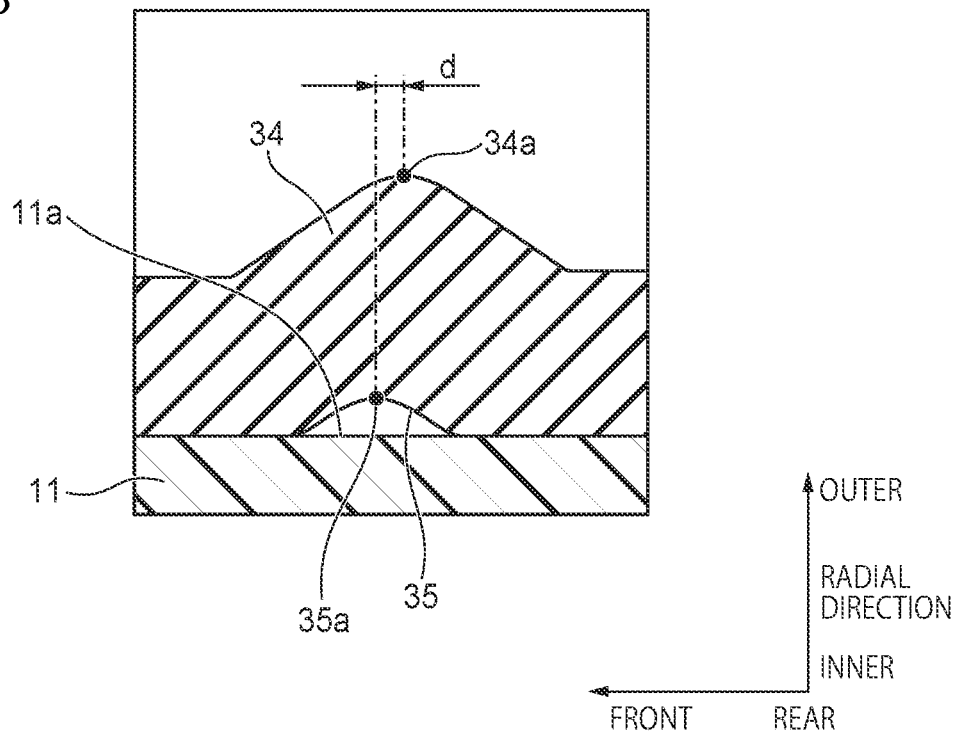
FIG. 8B is an enlarged view of the periphery of a second seal portion shown in FIG. 7.

As shown in FIG. 8B, in this example, the innermost end 35*a* of the groove inner surface of the second depressed portion 35 is located on the front side of the protruding end 34*a* of the second seal portion 34 by a distance d in the front-rear direction. The action caused by this positional relationship will be described later.

As shown in FIG. 7, the packing 30 is provided with an annular flange 37 protruding to the radially outer side at a position in the front-rear direction adjacent to the front side of the rear end portion 36 of the packing 30. An annular third seal portion 38 protruding forward is provided on the front end surface of the flange 37. The detailed shape of the packing 30 has been described above.

By inserting the tubular portion 11 into the fitting hole 41 (see FIG. 1) penetrating in the front-rear direction of the mating component 40, the housing 10 on which the packing 30 having the shape described above is mounted and in which the mating housing 20 is accommodated is fitted to the mating component 40. The inner peripheral surface 41*a* of the fitting hole 41 has a shape corresponding to the outer peripheral shape of the packing 30 as viewed in the front-rear direction. An annular tapered surface 41*b* (see FIGS. 9A to 9C) is formed at a corner portion at which the distal end surface (rear end surface) 43 (see FIGS. 9A to 9C and 10) of the mating component 40 and the inner peripheral surface 41*a* of the fitting hole 41 intersect each other. A pair of bolt holes 42 penetrating in the front-rear direction are provided at both end portions of the mating component 40 in the width direction so as to correspond to the pair of bolt holes 19 of the housing 10.

In order to fit the housing 10 and the mating component 40, first, the mating component 40 is disposed in front of the housing 10. Next, the fitting hole 41 of the mating component 40 is externally inserted into the tubular portion 11 of the housing 10 from the front side until the distal end surface 43 of the mating component 40 comes into contact with the distal end surface 16*a* (see FIG. 10) of the flange portion 16 of the housing 10 such that the packing 30 is sandwiched in the annular gap between the inner peripheral surface 41*a* of the fitting hole 41 and the outer peripheral surface 11*a* of the tubular portion 11.

Figure 9A:
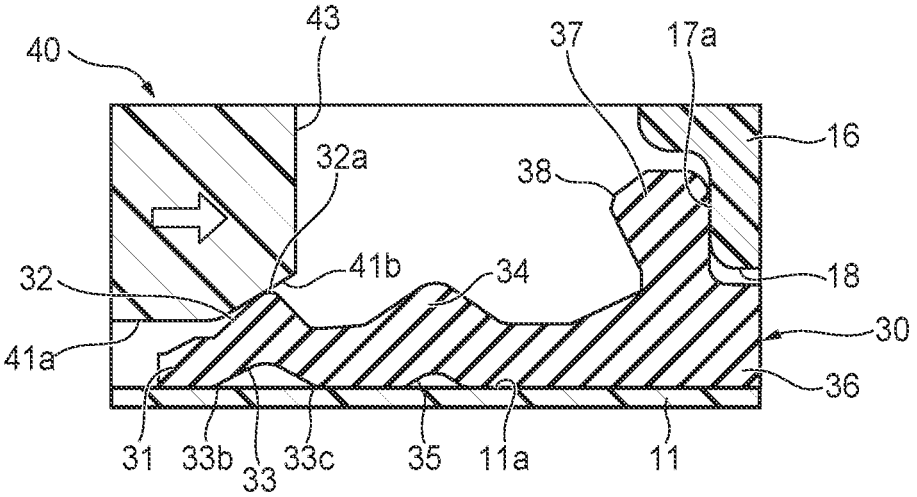
FIG. 9A to FIG. 9C are views for explaining a process in which the first seal portion is crushed by the mating component.

In the progress of such a fitting operation, first, as shown in FIG. 9A, the tapered surface 41*b* of the mating component 40 presses the vicinity of the protruding end 32*a* of the first seal portion 32 of the packing 30, so that the first seal portion 32 receiving the pressing force presses the outer peripheral surface 11*a* of the tubular portion 11 to the radially inner side. As a result, the leading edge 33*b* and the rear edge 33*c* of the first depressed portion 33 are pressed toward the radially outer side from the outer peripheral surface 11*a*.

Figure 9B:
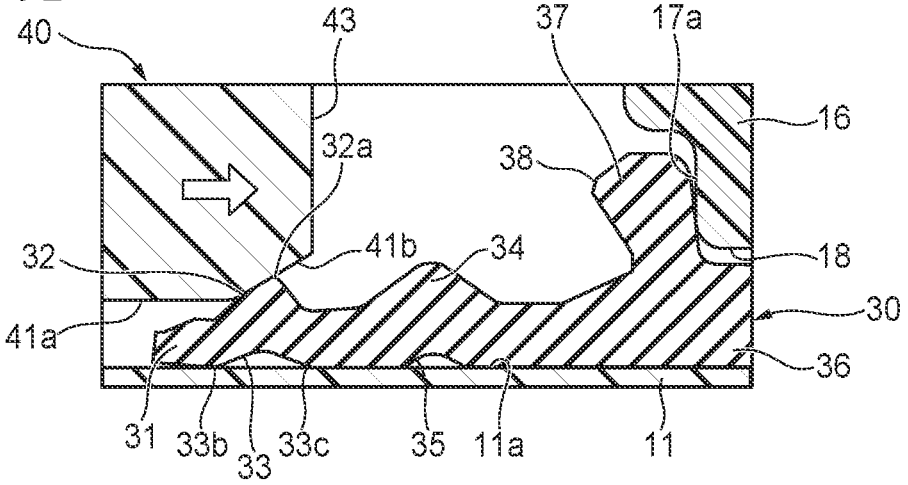

As described above, when the fitting operation progresses while the state in which the protruding end 32*a* of the first seal portion 32 is pressed to the radially inner side and the leading edge 33*b* and the rear edge 33*c* of the first depressed portion 33 are pressed to the radially outer side is maintained, as illustrated in FIG. 9B, the first seal portion 32 is deformed so as to be crushed to the radially inner side (such that the depression of the first depressed portion 33 is reduced) and to expand in the front-rear direction toward the periphery of the first seal portion 32. Further, as the deformation of the first seal portion 32 toward the radially inner side and the deformation of the first seal portion 32 expanding in the front-rear direction are caused, as described above, the front end portion 31 of the packing 30 is deformed so as to be displaced to the radially inner side (away from the outer peripheral surface 11*a*) due to the leading edge 33*b* of the first depressed portion 33 being located on the front side with respect to the protruding end 32*a* of the first seal portion 32.

The deformation of the first seal portion 32 expanding in the front-rear direction proceeds while resisting the frictional force generated between the constituent material of the packing 30 (hereinafter, simply referred to as "constituent material") and the outer peripheral surface Ia. In this regard, since the contact area between the packing 30 and the outer peripheral surface 11*a* is reduced in the front region of the first seal portion 32 due to the displacement of the front end portion 31 of the packing 30 toward the radially outer side, the frictional force is reduced. As a result, since the constituent material positioned in the front region of the first seal portion 32 easily slides forward on the outer peripheral surface 11*a*, the deformation of the first seal portion 32 expanding toward the front-rear direction (particularly, forward) becomes easy.

As described above, the radial thickness of the first seal portion 32 at the protruding end 32*a* of the first seal portion 32 is larger than the radial thickness of the first seal portion 32 at the front-rear direction position different from the protruding end 32*a* (see FIG. 8A). Accordingly, when the first seal portion 32 is crushed toward the radially inner side, bending is likely to occur in the periphery of the protruding end 32*a*, and the front end portion 31 of the packing 30 is promoted to be displaced to the radially outer side. Furthermore, as described above, the portion of the first seal portion 32 where the thickness is the thinnest in the radial direction is located on the front side of the protruding end 32*a* of the first seal portion 32 (see FIG. 8A). As a result, the displacement of the front end portion 31 of the packing 30 toward the radially outer side due to the bending in the periphery of the first seal portion 32 described above is further promoted. As a result, since the contact area between the packing 30 and the outer peripheral surface 11*a* is further reduced, the frictional force is further reduced, thereby further facilitating the deformation expanding in the front-rear direction (in particular, forward) of the first seal portion 32. As described above, since the deformation expanding to the front-rear direction (particularly, forward) of the first seal portion 32 is facilitated, the deformation of the first seal portion 32 toward the radially inner side becomes easy, and the tapered surface 41*b* of the mating component 40 can smoothly pass over the first seal portion 32.

Further, according to experiments, discussions, and the like by the inventor, as described above, the radial thickness of the first seal portion 32 at the protruding end 32*a* of the first seal portion 32 is larger than the radial thickness of the first seal portion 32 at the position in the front-rear direction different from the protruding end 32*a*, so that a portion different from the protruding end 32*a* of the first seal portion 32 is preferentially deformed. Therefore, an increase in the contact area between the protruding end 32*a* and the tapered surface 41*b* of the mating component 40 due to collapse of the protruding end 32*a* is suppressed, and an increase in the frictional force generated between the protruding end 32*a* and the tapered surface 41*b* is also suppressed. As a result, the tapered surface 41*b* of the mating component 40 can smoothly pass over the first seal portion 32.

Figure 9C:
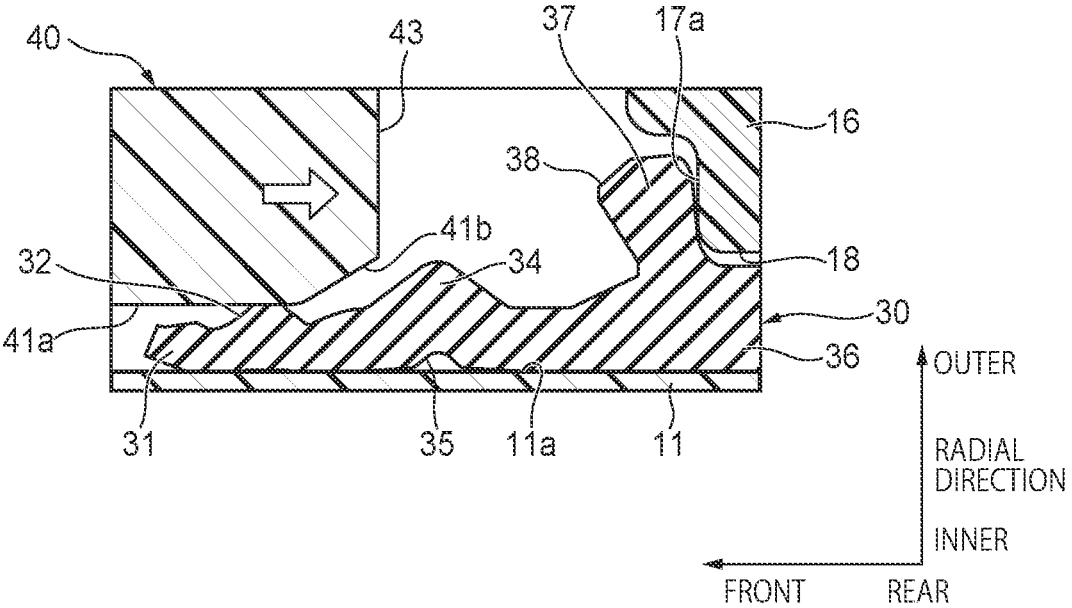

After the tapered surface 41*b* of the mating component 40 passes over the first seal portion 32, as shown in FIG. 9C, the first seal portion 32 is crushed to the radially inner side, and is maintained in a state in which the depression of the first depressed portion 33 is substantially eliminated. Here, as described above, the volume of the annular groove space of the first depressed portion 33 is equal to or larger than the volume of the annular protruding shape of the first seal portion 32 (see FIG. 8A). Accordingly, when the first seal portion 32 is deformed toward the radially inner side, the constituent material can easily escape, and the degree of compression generated in the first seal portion 32 can be reduced. Accordingly, it becomes easy to maintain a state in which the first seal portion 32 can appropriately exhibit the seal performance for a long period of time.

When the fitting operation further proceeds after the tapered surface 41*b* of the mating component 40 passes over the first seal portion 32, the tapered surface 41*b* of the mating component 40 presses the second seal portion 34. Accordingly, as in the case of the first seal portion 32, the second seal portion 34 is deformed so as to be crushed toward the radially inner side (such that the depression of the second depressed portion 35 is reduced) and to expand in the front-rear direction toward the periphery of the second seal portion 34.

Here, since the tapered surface 41*b* of the mating component 40 has already passed over the first seal portion 32, the possibility of the abnormal deformation of the first seal portion 32 (that is, excessive movement of the constituent material due to bite, buckling, or the like) is extremely low. Therefore, the deformation of the second seal portion 34 (in particular, the deformation expanding forward) is unlikely to be hindered by the deformation of the first seal portion 32. Further, as described above, the innermost end 35*a* of the groove inner surface of the second depressed portion 35 is located on the front side with respect to the protruding end 34*a* of the second sealing portion 34 (see FIG. 8B). Therefore, the radial thickness (that is, the strength) of the portion of the second seal portion 34 on the rear side with respect to the protruding end 34*a* is higher than the thickness of the portion of the second seal portion 34 on the front side with respect to the protruding end 34*a*. As a result, when the tapered surface 41*b* of the mating component 40 passes over the second seal portion 34, it is possible to prevent the second seal portion 34 from being bitten or the like due to the second seal portion 34 being pushed to the rear side by the frictional force between the second seal portion 34 and the tapered surface 41*b*. In this way, the tapered surface 41*b* of the mating component 40 can smoothly pass over the second seal portion 34.

When the fitting operation further progresses after the tapered surface 41*b* of the mating component 40 passes over the second seal portion 34, the distal end surface 43 of the mating component 40 comes into contact with a third seal portion 38 of the packing 30, and then the distal end surface 43 approaches the distal end surface 16*a* (see FIG. 10) of the flange portion 16 of the housing 10 while crushing the third seal portion 38 toward the rear side toward the bottom surface 17*a* of the annular recess 17. When the distal end surface 43 of the mating component 40 comes into contact with the distal end surface 16*a* of the flange portion 16, the fitting between the housing 10 and the mating component 40 is completed (see FIGS. 1 and 10).

Figure 10:
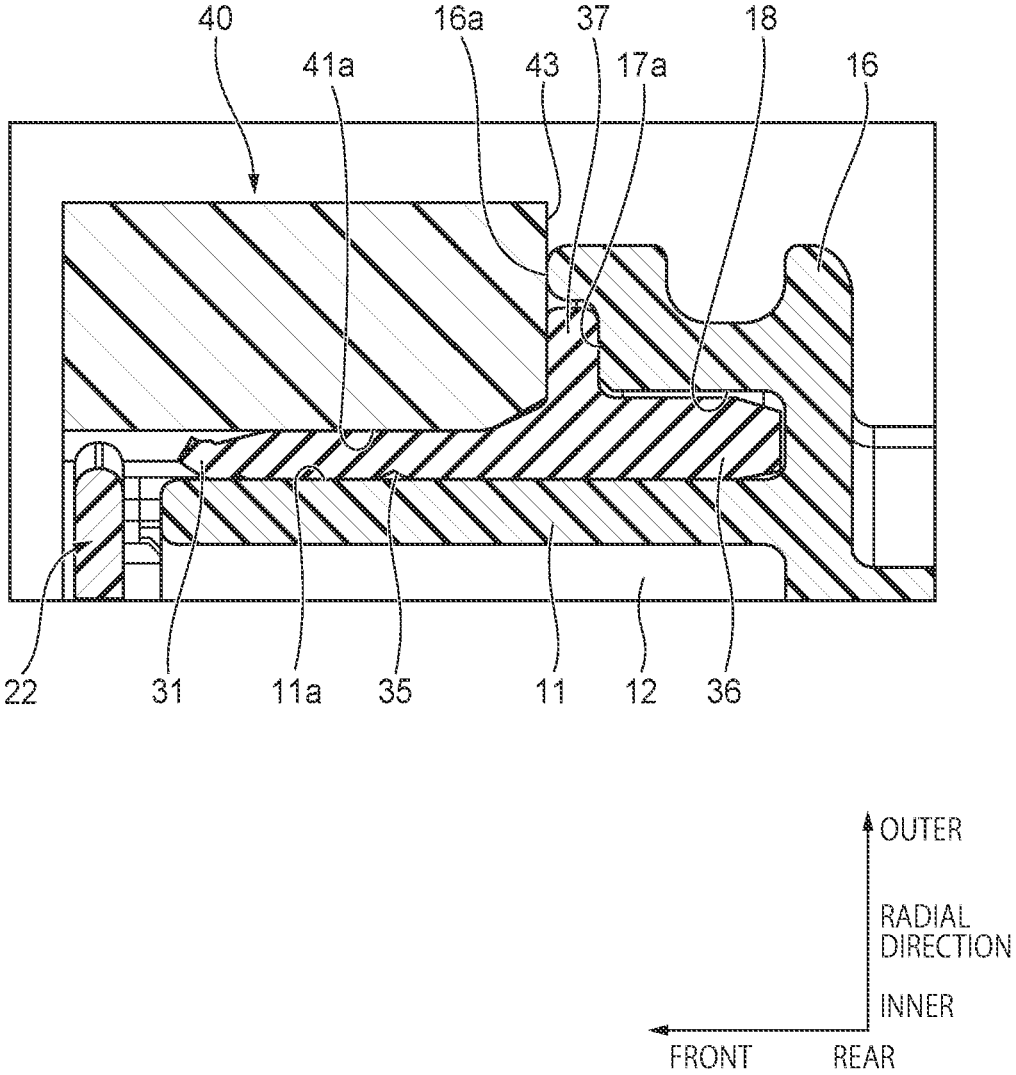
FIG. 10 is an enlarged view of the periphery of the packing in the A-A cross section of FIG. 1.

As described above, in the fitting completion state of the housing 10 and the mating component 40, as shown in FIG. 10, the first seal portion 32 and the second seal portion 34 are crushed in the radial direction between the inner peripheral surface 41*a* of the fitting hole 41 and the outer peripheral surface 11*a* of the tubular portion 11, and press contact with both the inner peripheral surface 41*a* and the outer peripheral surface 11*a*. As a result, the packing 30 seals the annular gap between the inner peripheral surface 41*a* of the fitting hole 41 and the outer peripheral surface 11*a* of the tubular portion 11 in a liquid-tight manner. Regarding the sealing function by pressing of the packing 30 in the radial direction, the first seal portion 32 and the second seal portion 34 function as an auxiliary seal and a main seal, respectively.

Further, in the fitting completed state, as shown in FIG. 10, the third seal portion 38 is crushed in the front-rear direction (fitting direction) between the distal end surface 43 of the mating component 40 and the bottom surface 17*a* of the annular recess 17 of the housing 10, and is pressed into contact with both the distal end surface 43 and the bottom surface 17*a*. As a result, the packing 30 seals the annular gap between the distal end surface 43 of the mating component 40 and the bottom surface 17*a* of the annular recess 17 in a liquid-tight manner.

When the housing 10 and the mating component 40 are fitted to each other, the housing 10 and the mating component 40 are fastened and fixed by using a pair of bolts (not shown) inserted into the pair of bolt holes 19 (see FIG. 2) of the housing 10 and the pair of bolt holes 42 (see FIG. 1) of the mating component 40.

The distal end portions of the tab portions of the male terminals (not shown) accommodated in the plurality of terminal accommodating chambers 23 of the mating housing 20 accommodated in the housing 10 are inserted through the through holes 15 (see FIG. 6) of the housing 10 and are located in the internal space of the fitting recessed portion 13 of the housing 10. Another housing (not shown) is inserted into and fitted into the fitting recess 13 of the housing 10. Accordingly, the plurality of female terminals (not shown) accommodated in the other housing and the tab portions of the plurality of male terminals accommodated in the terminal accommodating chamber 23 come into contact with each other, and the plurality of female terminals and the plurality of male terminals are electrically connected to each other.

As described above, according to the connector 1 of the present embodiment, the packing 30 includes the annular first seal portion 32 protruding to the radially outer side at a position away from the front end portion 31 toward the rear side, and the annular first depressed portion 33 provided on the surface of the radially inner side of the first seal portion 32 and depressed to the radially outer side. Further, the leading edge 33*b* of the first depressed portion 33 is configured to be located on the front side with respect to the protruding end 32*a* of the first seal portion 32. When the housing 10 to which the packing 30 is attached is fitted to the mating component 40, the protruding end 32*a* of the first seal portion 32 is pressed against the mating component 40, and the leading edge 33*b* and the rear edge 33*c* of the first depressed portion 33 are pressed against the housing 10. Further, at this time, the front end portion 31 of the packing 30 is displaced in a direction away from the housing 10 so as to warp with the vicinity of the front edge 33*b* of the first depressed portion 33 as a center. In other words, the packing 30 is supported at three points of the protruding end 32*a* of the first seal portion 32, the leading edge 33*b* of the first depressed portion 33, and the rear edge 33*c*.

Accordingly, since the contact area between the front end portion 31 of the packing 30 and the housing 10 is reduced, the two members easily slide, and when the first seal portion 32 is crushed, the rubber material or the like constituting the first seal portion 32 is easily deformed to expand to the periphery. In addition, since the space between the housing 10 and the mating component 40 is sealed at three locations of the protruding end 32*a* of the first seal portion 32 and the front edge 33*b* and the rear edge 33*c* of the first depressed portion 33, the seal performance of the packing 30 is unlikely to be impaired. Therefore, the connector 1 according to the present embodiment can achieve both the seal performance of the packing 30 and the workability of the operation of fitting the connector 1 using the packing 30.

Furthermore, according to the connector 1 of the present embodiment, the thickness of the protruding end 32*a* of the first seal portion 32 is thicker than the thickness at a portion different from the protruding end 32*a*. According to experiments, discussions, and the like by the inventor, since the first seal portion 32 has such a shape, a portion different from the protruding end 32*a* of the first seal portion 32 is preferentially deformed, and it is suppressed that the protruding end 32*a* is crushed and the contact area between the protruding end 32*a* and the mating component 40 is increased. Further, when the first seal portion 32 is crushed, bending is likely to occur in the periphery of the protruding end 32*a* (that is, a portion different from the protruding end 32*a*), and the front end portion 31 of the packing 30 is promoted to be displaced in a direction away from the housing 10. As a result, the front end portion 31 of the packing 30 and the housing 10 easily slide, and the deformation of the first seal portion 32 is further facilitated. Therefore, the connector 1 according to the present embodiment is more excellent in workability of the operation of fitting the connector 1 using the packing 30.

Furthermore, according to the connector 1 of the present embodiment, the depression depth a2 of the first depressed portion 33 is smaller than the protrusion height a1 of the first seal portion 32 (see FIG. 8A). Further, the groove width b2 of the first depressed portion 33 is larger than the protrusion width b1 of the first seal portion 32 (see FIG. 8A). In other words, the degree of depression of the first depressed portion 33 is gentler than the degree of protrusion of the first seal portion 32. Accordingly, when the packing 30 is molded by injection molding or the like, the first depressed portion 33 is likely to be separated from the mold (that is, the mold releasability is improved), and the productivity of the packing 30 can be improved. Further, by increasing the volume of the groove space of the first depressed portion 33, it becomes easy to escape the rubber material or the like when the first seal portion 32 is deformed at the time of fitting, and it is possible to reduce the degree of compression generated in the first seal portion 32. Accordingly, it becomes easy to maintain a state in which the packing 30 can appropriately exhibit the seal performance for a long period of time.

Further, according to the connector 1 of the present embodiment, the packing 30 includes the second seal portion 34 and the second depressed portion 35 on the rear side in addition to the first seal portion 32 and the first depressed portion 33. Accordingly, when the housing 10 and the mating component 40 are fitted to each other, the packing 30 is disposed such that the second seal portion 34 is crushed after the first seal portion 32 is crushed. In this case, since the first seal portion 32 is easily deformed as described above, the deformation of the second seal portion 34 is unlikely to be hindered by the first seal portion 32. Further, since the innermost end 35*a* of the groove inner surface of the second depressed portion 35 is positioned on the front side with respect to the protruding end 34*a* of the second sealing portion 34 (see FIG. 8B), the strength of the portion on the rear side is higher than the portion on the front side of the protruding end 34*a* of the second seal portion 34. As a result, it is possible to prevent the packing 30 from being bitten due to the second seal portion 34 being pushed to the rear side by the mating component 40 at the time of fitting. Accordingly, even when the first seal portion 32 and the second seal portion 34 are provided in the packing, the seal performance as designed can be more reliably exhibited without requiring an excessive external force to fit the connector 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

For example, in the above-described embodiment, in the packing 30, the second seal portion 34 and the second depressed portion 35 are provided on the rear side of the first seal portion 32 and the first depressed portion 33. In contrast, the second seal portion 34 and the second recess portion 35 may not be provided.

Further, in the above-described embodiment, the flange 37 and the third seal portion 38 are provided on the rear side of the second seal portion 34 and the second depressed portion 35 in the packing 30. In contrast, the flange 37 and the third seal portion 38 may not be provided.

Furthermore, in the above-described embodiment, the radial thickness of the first seal portion 32 at the protruding end 32*a* of the first seal portion 32 is larger than the radial thickness of the first seal portion 32 at the front-rear direction position different from the protruding end 32*a*. In contrast, a portion of the first seal portion 32 where the thickness is the thickest in the radial direction may be located at a position in the front-rear direction different from the protruding end 32*a* of the first seal portion 32.

Further, in the above-described embodiment, the depression depth a2 of the first depressed portion 33 toward the radially outer side is smaller than the protruding height a1 of the first sealing portion 32 toward the radially outer side, and the groove width b2 of the first depressed portion 33 is larger than the protruding width b1 of the first seal portion 32. In contrast, the depression depth a2 of the first depressed portion 33 toward the radially outer side may be larger than the protruding height a1 of the first seal portion 32 toward the radially outer side. Similarly, the groove width b2 of the first depressed portion 33 may be smaller than the protruding width b1 of the first seal portion 32.

According to the above exemplary embodiments, the connector (1) comprising:

a housing (10) to be fitted to a mating component (40); and an annular packing (30) to be sandwiched between the housing (10) and the mating component (40) and comes into contact with both the housing (10) and the mating component (40), wherein the packing (30) having:

an annular seal portion (32) protruding toward a radially outer side at a position away from an end portion (31) on one side of the packing in a fitting direction of the housing (10) and the mating component (40) toward another one side in the fitting direction, and an annular depressed portion (33) located on a surface of the seal portion (32) on the radially inner side and depressed toward the radially outer side, the edge (33*b*) on the one side of the depressed portion (33) being located on the one side with respect to the protruding end (32*a*) of the seal portion (32), the housing (10) being disposed on the radially inner side of the packing (30), upon the housing (10) and the mating component (40) being fitted to each other, the protruding end (32*a*) of the seal portion (32) being in contact with the mating component (40), the edge (33*b*) on the one side and the edge (33*c*) on the another one side of the depressed portion (33) being in contact with the housing (10), and the end portion (31) being displaced in a direction away from the housing (10) to warp with a vicinity of the edge (33*b*) on the one side as a center.

According to the connector having the above configuration, the packing includes an annular seal portion that protrudes to the radially outer side at a position away from an end portion on one side in the fitting direction of the housing and the mating component (for example, a device case to which the connector is assembled, a mating connector, or the like) toward the other side in the fitting direction, and an annular depressed portion that is located on a surface on the radially inner side of the seal portion and is depressed to the radially outer side. Further, an edge on one side of the depressed portion is located on the one side with respect to the protruding end of the seal portion. When the housing to which the packing is attached is fitted to the mating component, the protruding end of the seal portion is pressed against the mating component, and the edge on the one side and the edge on the other side of the depressed portion are pressed against the housing. Further, at this time, the end portion of the packing is displaced in a direction away from the housing (that is, so as to lift from the housing surface) such that the end portion of the packing is warped with the vicinity of the edge on one side of the depressed portion as the center. In other words, the packing is supported at three points of a protruding end of the seal portion, an edge on one side of the depressed portion, and an edge on the other side. Accordingly, the contact area between the end portion of the packing and the housing is reduced, the sliding between the two is facilitated, and the deformation (that is, the latter deformation described above) in which the rubber material or the like constituting the seal portion expands to the periphery becomes easy. On the other hand, since the space between the housing and the mating component is sealed at three positions of the protruding end of the seal portion and the pair of edges of the depressed portion, the seal performance of the packing is unlikely to be impaired. Therefore, the connector of the present configuration can achieve both the seal performance of the packing and the workability of the operation of fitting the connector using the packing.

In the connector (1), a thickness of the seal portion (32) at the protruding end (32*a*) may be thicker than the thickness of the seal portion (32) at a portion different from the protruding end (32*a*).

According to the connector having the above configuration, the thickness at the protruding end of the seal portion is thicker than the thickness at a portion different from the protruding end. According to experiments, discussions, and the like by the inventor, since the seal portion has such a shape, when the connector is fitted, the portion different from the protruding end is deformed so as to be bent preferentially, whereby the end portion of the packing is promoted to be displaced so as to warp. Furthermore, it is also possible to suppress an increase in the contact area with the mating component due to collapse of the protruding end. Therefore, the connector of the present configuration is further excellent in workability of the operation of fitting the connector.

According to experiments, discussions, and the like by the inventor, when a portion of the seal portion where the thickness is the thinnest is on a position closer to the end portion described above than the protruding end of the seal portion (that is, one side in the fitting direction), bending of the seal portion described above is further facilitated, and the end portion is further promoted to be displaced so as to wrap.

In the connector (1), a groove width (b2) of the depressed portion (33) in the fitting direction may be larger than a protrusion width (b1) of the seal portion (32) in the fitting direction.

According to the connector having the above configuration, the groove width of the depressed portion is larger than the protrusion width of the seal portion. In other words, the degree of depression of the depressed portion is gentler than the degree of protrusion of the seal portion. Accordingly, when the packing is molded using the mold, the depressed portion is likely to be separated from the mold (that is, the mold releasability is improved), and the productivity of the packing can be improved. Further, by increasing the volume of the groove space of the depressed portion, it becomes easy to escape the rubber material or the like when the seal portion is deformed at the time of fitting, and the degree of compression generated in the seal portion can be reduced. Thereby, the deterioration of the packing is suppressed, and the state in which the packing can appropriately exhibit the seal performance can be maintained for a long period of time.

In the connector (1), the packing (30) further has:

an annular second seal portion (34) protruding to the radially outer side at a position away from the seal portion (32) toward the another one side, and an annular second depressed portion (35) located on a surface of the radially inner side of the second seal portion (34) and depressed to the radially outer side, wherein an innermost end (35*a*) of a groove inner surface of the second depressed portion (35) may be located closer to the one side than a protruding end (34*a*) of the second seal portion (34).

According to the connector having the above configuration, the packing includes the second seal portion and the second depressed portion in addition to the seal portion and the depressed portion described above. Accordingly, for example, when the packing is disposed such that the second seal portion is crushed after the seal portion is crushed in order from one side in the fitting direction when the housing and the mating component are fitted to each other, the seal portion that is deformed first is easily deformed so as to expand in the gap between the housing and the mating component as described above. Therefore, it is possible to suppress the rubber material or the like constituting the seal portion from escaping toward the second seal portion and hindering the deformation of the second seal portion. Therefore, even when such a double seal structure is employed, both of the seal portions can be appropriately deformed. Further, since the innermost end of the groove inner surface of the second depressed portion is located on one side in the fitting direction with respect to the protruding end of the second sealing portion, the strength of the portion on the other side is higher than the portion on the one side of the protruding end of the second sealing portion. As a result, it is possible to suppress the bitten or the like of the packing due to the second seal portion being pushed toward the other side in the fitting direction by the mating component at the time of fitting. As described above, even in the case where the plurality of seal portions are provided in the packing, it is possible to appropriately exhibit the seal performance without requiring an excessive external force for fitting the connector.

As described above, according to the present invention, it is possible to provide a connector capable of achieving both the seal performance of the packing and the workability of the operation of fitting the connector using the packing.

What is claimed is:

1. A connector comprising:

a housing configured to be fitted to a mating component and including a surface; and an annular packing configured to be sandwiched between the housing and the mating component when the housing is fitted to the mating component, the annular packing contacts the surface of the housing, and the annular packing is configured to contact the mating component when the housing is fitted to the mating component, the packing having:

an annular seal portion protruding toward a radially outer side at a position away from an end portion on one side of the packing in a fitting direction of the housing and the mating component toward another one side in the fitting direction, and an annular depressed portion located on a surface of the seal portion on the radially inner side and depressed toward the radially outer side, an edge of the depressed portion on the one side being positioned on the one side with respect to a protruding end of the seal portion, the housing being disposed on a radially inner side of the packing, upon the housing and the mating component being fitted to each other, the protruding end of the seal portion being in contact with the mating component, the edge of the depressed portion on the one side and an edge of the depressed portion on the another one side being in contact with the housing, and the end portion being displaced in a direction away from the housing to warp with a vicinity of the edge on the one side as a center, wherein the depressed portion is disengaged from the surface of the housing in a state before the housing is fitted to the mating member, wherein the edge of the depressed portion on the one side is a boundary between the depressed portion and an inner surface on the radially inner side of the annular packing that is in contact with the housing in the state before the housing is fitted to the mating member, wherein the edge of the depressed portion on the another side is another boundary between the depressed portion and the inner surface in the state before the housing is fitted to the mating component, wherein the annular packing further includes:

an outer surface on the radially outer side of the annular packing, the outer surface is parallel to the fitting direction, the annular seal portion protrudes from the outer surface, a leading edge at a first boundary of the outer surface and one side of the annular seal portion in the state before the housing is fitted to the mating component, and a rear edge at a second boundary of the outer surface and another side of the seal portion in the state before the housing is fitted to the mating component, and wherein a groove width of the depressed portion measured from the edges of the depressed portion in the fitting direction is larger than a protrusion width of the seal portion measured from the leading edge to the rear edge in the fitting direction.

2. The connector according to claim 1, wherein a thickness of the seal portion at the protruding end is thicker than a thickness of the seal portion at a portion different from the protruding end.

3. A connector a housing configured to be fitted to a mating component and including a surface; and an annular packing configured to be sandwiched between the housing and the mating component when the housing is fitted to the mating component, the annular packing contacts the surface of the housing, and the annular packing is configured to contact the mating component when the housing is fitted to the mating component, the packing having:

an annular seal portion protruding toward a radially outer side at a position away from an end portion on one side of the packing in a fitting direction of the housing and the mating component toward another one side in the fitting direction, and an annular depressed portion located on a surface of the seal portion on the radially inner side and depressed toward the radially outer side, an edge of the depressed portion on the one side being positioned on the one side with respect to a protruding end of the seal portion, the housing being disposed on a radially inner side of the packing, upon the housing and the mating component being fitted to each other, the protruding end of the seal portion being in contact with the mating component, the edge of the depressed portion on the one side and an edge of the depressed portion on the another one side being in contact with the housing, and the end portion being displaced in a direction away from the housing to warp with a vicinity of the edge on the one side as a center, wherein the packing has:

an annular second seal portion protruding to the radially outer side at a position away from the seal portion toward the another one side, and an annular second depressed portion located on a surface of the radially inner side of the second seal portion and depressed to the radially outer side, an innermost end of a groove inner surface of the second depressed portion is located closer to the one side than is a protruding end of the second seal portion.

* * * * *